US005887626A

United States Patent [19]

Hugo

[11] Patent Number: 5,887,626

[45] Date of Patent: Mar. 30, 1999

[54] GLAND STRUCTURE FOR LINER BAGS

[75] Inventor: Barry Hugo, Durbanville, South Africa

[73] Assignee: Stopak (Proprietary) Limited, Cape Town, South Africa

[21] Appl. No.: 861,776

[22] Filed: May 22, 1997

[51] Int. Cl.[6] ..... F16L 55/10; B65D 35/00

[52] U.S. Cl. ..... 138/89; 138/119; 222/92; 220/375; 215/306

[58] Field of Search ..... 138/89, 89.1–89.4, 138/119; 220/359, 288, 375; 215/306; 222/92, 105, 107; 141/382, 383, 386

[56] References Cited

U.S. PATENT DOCUMENTS

| | | | |
|---|---|---|---|
| 1,021,203 | 3/1912 | Matchette | 215/306 |
| 1,201,196 | 10/1916 | Kizer | 215/306 |
| 1,662,189 | 3/1928 | Hyatt | 220/375 X |
| 2,446,155 | 7/1948 | Karle | 220/375 X |
| 2,778,533 | 1/1957 | Savary | 222/92 |
| 2,921,716 | 1/1960 | Schiller | 222/92 |
| 2,977,973 | 4/1961 | Chakine | 138/89 |
| 2,981,443 | 4/1961 | Baldwin | 222/183 |
| 3,081,911 | 3/1963 | Scholle | 222/107 |
| 3,282,477 | 11/1966 | Henchert | 138/89 |
| 3,583,602 | 6/1971 | Gruber | 222/92 |
| 4,004,614 | 1/1977 | Mackal et al. | 138/89.2 |
| 4,261,386 | 4/1981 | Young | 137/467 |
| 4,709,835 | 12/1987 | Kruger et al. | 222/92 X |
| 4,793,504 | 12/1988 | Towns et al. | 220/258 X |
| 4,795,062 | 1/1989 | Bedwell et al. | 222/92 |
| 4,813,578 | 3/1989 | Gordon et al. | 220/258 X |
| 4,934,654 | 6/1990 | Linnemann . | |
| 4,998,990 | 3/1991 | Richter et al. | 222/92 |
| 5,351,849 | 10/1994 | Jagenburg et al. | 220/403 |
| 5,657,792 | 8/1997 | Prest | 138/89 |

FOREIGN PATENT DOCUMENTS

| | | |
|---|---|---|
| 0367937 | of 0000 | European Pat. Off. . |
| 1162271 | 1/1964 | Germany . |

*Primary Examiner*—Patrick F. Brinson
*Attorney, Agent, or Firm*—Ladas & Parry

[57] ABSTRACT

A one piece gland is disclosed for attachment to a liner bag. The gland includes a flange and a filling sleeve. The sleeve itself comprises a tubular portion which merges with the flange, an intermediate portion which defines an external groove and an externally threaded free end portion. Loops defining passages are provided between the tubular portion and the flange. The one piece gland forms part of a gland structure which includes an internally threaded cap which includes a pair of loops similar to the loops.

7 Claims, 2 Drawing Sheets

GLAND STRUCTURE FOR LINER BAGS

FIELD OF THE INVENTION

THIS INVENTION relates to gland structures for liner bags.

BACKGROUND TO THE INVENTION

Bulk liquids are transported in various ways. One of these ways is in what is called a liner bag. A liner bag is a relatively large bag of sheet synthetic plastics material containing, for example, up to 1000 liters of liquid. Because the liner bag itself has little mechanical strength, the bag is contained within an outer structure. The outer structure is not liquid proof but supports the bag and prevents it bursting. The bag itself prevents liquid leaks.

Conventionally, a liner bag incorporates one or more of what are commonly referred to as glands. A gland comprises a flange which is welded to the sheet synthetic plastics material of the liner bag and a tubular portion onto which a sealing cap is screwed. The flange and cap form a gland structure and are shipped with the liner bag.

To fill the bag it is necessary to remove the cap. Using the thread onto which the cap was screwed (and which can be an internal thread or an external thread) an intermediate component is attached to the gland. This component is screwed into or onto the gland until the two engage with one another in a leak proof manner. The intermediate component has an external groove.

Liquid is fed into the bag through a hose which has, on the free end thereof, an attachment which is often referred to as a "cam-lock" , "snap-lock" or "tongue and groove" attachment. This attachment includes a sleeve to which the hose is secured. The sleeve has two diametrically opposed holes therein. The attachment further includes two levers which protrude radially outwardly on opposite sides of the sleeve. The levers project into the sleeve through said holes and the levers are pivotally mounted on the sleeve close to their inner ends. The inner ends of the levers are in the form of arcuate cams.

In use, the attachment is placed over the intermediate component so that the cams at the inner ends of the levers lie radially outwardly of the external groove of the intermediate component. Force is then applied to the outer ends of the levers so that their inner ends move inwardly. The cams enter the external groove at diametrically opposed locations thereof. The configuration of the cams is such that a force is exerted in one direction on the intermediate component and a force in the opposite direction on the attachment thereby locking the intermediate component and the attachment to one another in a leak proof manner. The liner bag is then filled.

Once filling is complete, the levers are pushed to their inoperative positions thereby releasing the attachment from the intermediate component by withdrawing the cams from the external groove. Once the attachment is free of the intermediate component, the intermediate component is unscrewed from the gland and the cap screwed back onto the gland.

BRIEF DESCRIPTION OF THE PRESENT INVENTION

According to the present invention there is provided a gland structure for a liner bag, the gland structure comprising a gland and a cap, the gland being a one piece moulding of synthetic plastics material and including a sleeve defining a filling passage and a flange protruding outwardly from the sleeve, said flange, in use, being welded to a liner bag, there being an external groove extending around said sleeve for receiving the cams of a hose attachment which has been fitted over said sleeve, and interengaging means for releasably attaching said cap to said sleeve to close the entrance to said filling passage.

The gland structure can include a loop on the cap and a loop on the gland, the loops defining passages for receiving a tie whereby the gland and cap can be connected to one another in a tamper evident manner. In the preferred form one end of the loop on the gland is connected to said sleeve and the other end of this loop is connected to said flange.

The loop on the cap can protrude outwardly beyond a cylindrical bounding wall of the cap.

To provide a visual indication that the cap has been properly tightened onto the gland, the loop on the cap is arranged so that it is axially aligned with the loop on the gland when said interengaging means are fully engaged.

It is possible for the gland to have two diametrically opposed loops and for the cap also to have two diametrically opposed loops.

In the preferred form a free end portion of said sleeve is externally threaded and said cap includes an end wall and an internally threaded peripheral skirt, the threading of said end portion and of said skirt forming said interengaging means. In another form a free end portion of said sleeve is internally threaded and said cap includes an end wall, a peripheral skirt and an externally threaded plug, there being between said skirt and said plug an annular gap for receiving said free end portion, and the threading of said end portion and of said plug forming said interengaging means.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
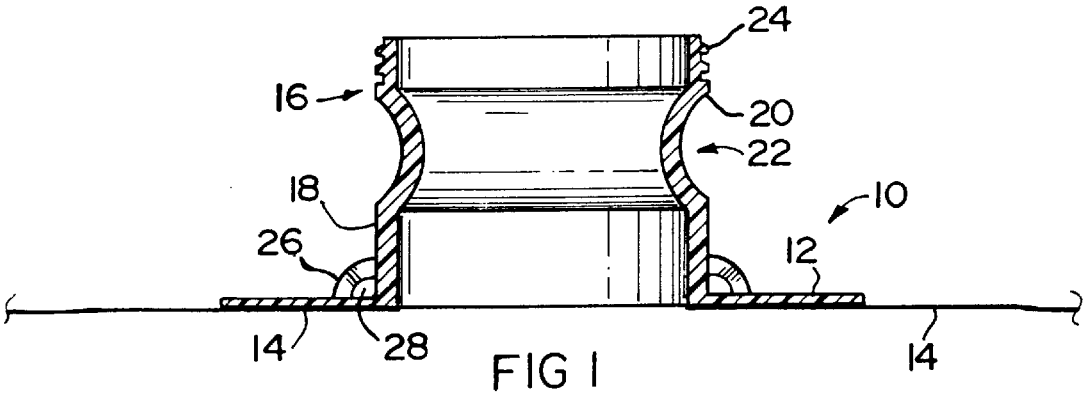
FIG. 1 is a section through a first form of gland for a liner bag.
Figure 2:
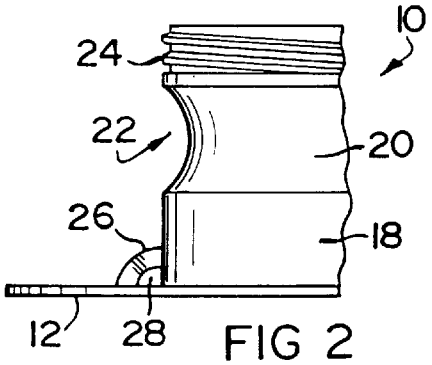
FIG. 2 is a section through a cap.
Figure 3:
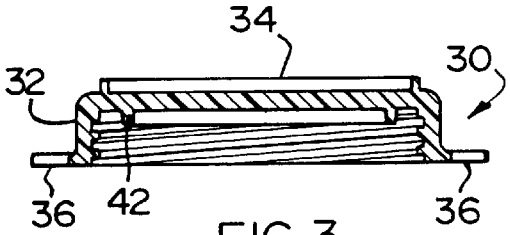
FIG. 3 is a partial view of the outside of the gland of FIG. 1.

Referring firstly to FIGS. 1 to 4, the gland structure illustrated comprises a gland 10 having a flange 12 which, in use, is welded or heat sealed to a liner bag designated 14 (FIG. 1). Only a small part of the liner bag 14 is illustrated and the flange 12 is shown as being outside the bag. The liner bag 14 could, however, be welded to the other surface of the flange 12 so that the flange 12 is inside the bag.

Moulded integrally with the flange 12 is a filling sleeve 16. The sleeve 16 includes a tubular portion 18 which merges with the flange 12, a portion 20 which defines an external groove 22 and an externally threaded free end portion 24. Two diametrically opposed loops 26 are provided in the angle between the flange 12 and the tubular portion 18. The loops 26 define passages 28.

Figure 4:
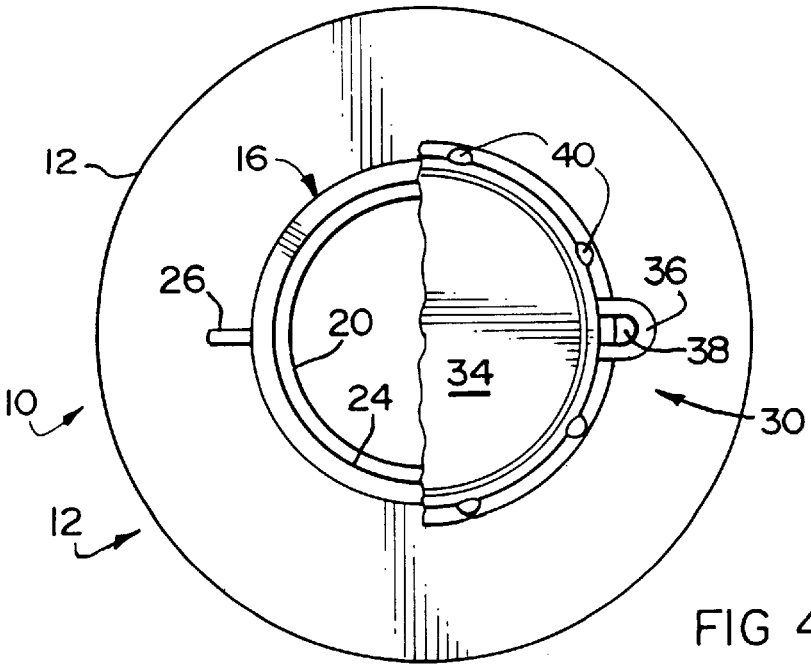
FIG. 4 is a top plan view of the cap and gland, the cap being partially broken away.

The filling passage through the gland 10 is, both before and after filling of the liner bag 14, closed by means of a cap designated 30 (FIGS. 2 and 4) which forms part of the gland structure. The cap 30 has an external peripheral skirt 32 and a disc-like end wall 34. The skirt 32, when the cap 30 is fitted to the gland 10, lies externally of the portion 24. The cap 30 has a pair of diametrically opposed loops 36 (one of which is shown in FIG. 4), the loops 36 defining passages 38. The cap 30 also has a number of circumferentially spaced protuberances 40 which facilitate gripping of the cap. The cap 30 also has a sealing lip 42 on the underside of the wall 34.

Figure 5:
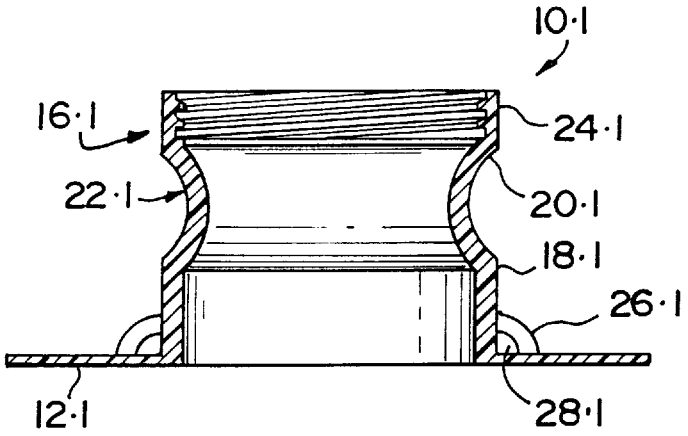
FIGS. 5, 6 and 7 are identical views to FIGS. 1, 2 and 3 and illustrate a second form of gland and cap.
Figure 6:
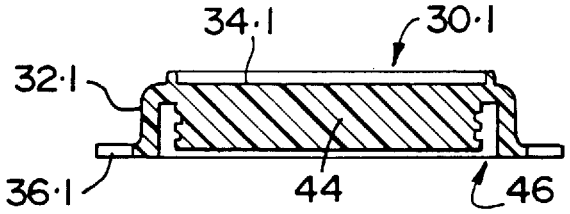
Figure 7:
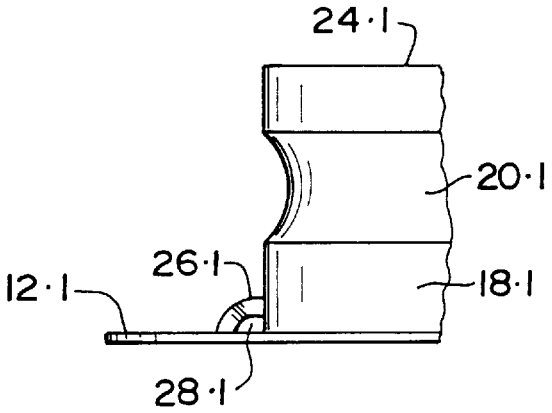

The gland of FIGS. 5 to 7 has many parts in common with the gland of FIGS. 1 to 4 and, where applicable, like reference numerals have been used with the addition of the suffix .1.

The gland of FIGS. 5, 6 and 7 is designated 10.1 and differs from the gland 10 in that the free end portion 24.1 is internally threaded rather than being externally threaded. The cap, designated 30.1, includes a skirt 32.1 and an end wall 34.1 which has a central plug 44 protruding from the inner face thereof. The plug 44 is externally threaded. The configuration of the portions 18.1 and 20.1 and of the groove 22.1 is identical in FIGS. 1 to 4 and FIGS. 5 to 7. The skirt 32.1 and the plug 44 define an annular gap 46 for receiving the free end portion 24.1

When the liner bag is manufactured, the gland 10 or 10.1 is welded to it by way of the flange 12, 12.1 and in register with a hole in the bag. The cap 30, 30.1 is then screwed onto the welded-on gland 10, 10.1. The liner bag is placed in the above described outer structure.

When the liner bag is to be filled, the cap 30, 30.1 is unscrewed and the cam-lock attachment described above placed over the filling sleeve 16, 16.1. It is assumed, as will invariably be the case, that the gland 10, 10.1 has been fixed to the top wall of the bag. The inner ends of the locking cams come into register with the groove 22, 22.1 but are spaced radially outwardly therefrom. When the levers of the cam-lock device are swung down about their pivotal mountings, the cams move radially inwardly into the groove 22, 22.1. The configuration of the cams is such that they exert an upward force on the filling sleeve 16, 16.1 and hence a downward force on the cam-lock attachment. This pulls a sealing zone of the cam-lock attachment into contact with the free end of the portion 24, 24.1. When the cams go over their dead centre positions, the cam-lock device is locked to the sleeve 16, 16.1. The bag is then filled through the filling hose, cam-lock device and filling sleeve 16, 16.1.

Once the liner bag is filled, the levers of the cam-lock attachment are swung upwardly thereby releasing their inner ends from the groove 22, 22.1. The hose and the cam-lock attachment are then lifted away from the sleeve 16, 16.1 and the cap 30, 30.1 attached to seal-off the liner bag.

The arrangement of the threading and the loops is such that the loops 36, 36.1 on the cap 30, 30.1 and the loops 26, 26.1 on the gland 10, 10.1 register with one another when the cap 30, 30.1 has been fully and properly screwed onto the sleeve 16, 16.1. One or more ties passed through the passages 28, 28.1 and 38, 38.1 provide a tamper evident feature.

Conventional means (not shown) for releasing an over pressure in the bag can be incorporated into the end wall 34 (FIGS. 1 to 4) or into the end wall 34.1 and plug 44 (FIGS. 5 to 7). One loop 26, 26.1 and one loop 28, 28.1 can be omitted if desired.

I claim:

1. A gland structure for a liner bag which is filled through a cam lock hose attachment temporarily attached to the gland structure, the gland structure comprising a gland and a cap, the gland being a one piece moulding of synthetic plastics material and including a sleeve defining a filling passage, there being an entrance to the filling passage at one end of the filling passage and a flange protruding outwardly from the sleeve, said flange, in use, being welded to a liner bag, there being an external groove extending around said sleeve for receiving cams of a cam lock hose attachment which has been fitted over said sleeve, said groove being bounded by a face which encircles the sleeve and which, in radial section, is of a curved configuration such that the depth of the groove in radial section increases progressively from each of its edges to a maximum at its centre, the groove configuration, when the cams of the cam lock hose attachment are applied thereto, causing the cam lock hose attachment to be pulled against said entrance to the filling passage, and interengaging means for releasably attaching said cap to said sleeve to close the entrance to said filling passage.

2. A gland structure as claimed in claim 1, and including a loop on the cap and a loop on the gland, the loops defining passages for receiving a tie whereby the gland and cap can be connected to one another in a tamper evident manner.

3. A gland structure as claimed in claim 2, wherein one end of the loop on the gland is connected to said sleeve and the other end of this loop is connected to said flange.

4. A gland structure as claimed in claim 2, wherein the loop on the cap protrudes outwardly beyond a cylindrical bounding wall of the cap.

5. A gland structure as claimed in claim 2, wherein the loop on the cap is axially aligned with the loop on the gland when said interengaging means are fully engaged.

6. A gland structure as claimed in claims 2, wherein the gland has two diametrically opposed loops and the cap has two diametrically opposed loops.

7. A gland structure for a liner bag, the gland structure comprising a gland and a cap, the gland being a one piece moulding of synthetic plastics material and including a sleeve defining a filling passage and a flange protruding outwardly from the sleeve, said flange, in use, being welded to the liner bag, said sleeve comprising means, including an external groove, for receiving cams of a cam lock hose attachment that has been fitted over the sleeve with the cams forcing a hose against the sleeve while permitting liquid from the hose to flow through the filling passage and into the liner bag, and interengaging means for releasably attaching said cap to said sleeve to close an entrance to said filling passage.

* * * * *